US012320242B2

(12) United States Patent
Ehman

(10) Patent No.: US 12,320,242 B2
(45) **Date of Patent: *Jun. 3, 2025**

(54) INVERTED SHROUD FOR STEAM ASSISTED GRAVITY DRAINAGE SYSTEM

(71) Applicant: ConocoPhillips Company, Houston, TX (US)

(72) Inventor: Kyle Robert Ehman, Houston, TX (US)

(73) Assignee: ConocoPhillips Company, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/241,280

(22) Filed: Sep. 1, 2023

(65) Prior Publication Data

US 2023/0407735 A1 Dec. 21, 2023

Related U.S. Application Data

(63) Continuation of application No. 17/515,751, filed on Nov. 1, 2021, now Pat. No. 11,795,797.

(60) Provisional application No. 63/108,018, filed on Oct. 30, 2020.

(51) Int. Cl.
*E21B 43/12* (2006.01)
*E21B 43/24* (2006.01)

(52) U.S. Cl.
CPC ..... *E21B 43/2408* (2013.01); *E21B 43/128* (2013.01)

(58) Field of Classification Search
CPC ..... E21B 43/2408; E21B 43/128
USPC ..... 166/303
See application file for complete search history.

(56) References Cited

U.S. PATENT DOCUMENTS

| | | | | |
|---|---|---|---|---|
| 7,032,675 | B2 * | 4/2006 | Steele | E21B 43/24 166/205 |
| 8,555,958 | B2 * | 10/2013 | Amaral | E21B 43/2406 166/263 |
| 2007/0074872 | A1 * | 4/2007 | Du | E21B 4/003 166/369 |
| 2021/0189805 | A1 * | 6/2021 | Beck | F04B 47/06 |

OTHER PUBLICATIONS

CENesis PHASE multiphase encapsulated production solution, 2018, Baker Hughes brochure; 6 pgs.
CENtrilift ESP Recirculation System, 2015, Baker Hughes brochure; 1 pg.

* cited by examiner

*Primary Examiner* — William D Hutton, Jr.
*Assistant Examiner* — Ashish K Varma
(74) *Attorney, Agent, or Firm* — Polsinelli PC

(57) ABSTRACT

Implementations described and claimed herein provide systems and methods for increasing production performance in a Steam Assisted Gravity Drainage system. In one implementation, an upper mating unit of an inverted shroud assembly is received with a lower mating unit of the inverted should assembly in a slidable relationship. The upper mating unit is coupled to a pump-intake assembly. The lower mating unit is coupled to a motor-seal assembly. The slidable relationship secures the pump-intake assembly to the motor-seal assembly. A motor of the motor-seal assembly is directly cooled by opening the motor to a production well based on an exterior attachment of the motor-seal assembly relative to an inverted shroud.

19 Claims, 18 Drawing Sheets

INVERTED SHROUD FOR STEAM ASSISTED GRAVITY DRAINAGE SYSTEM

CROSS-REFERENCE TO RELATED APPLICATIONS

This application is a continuation of and claims priority to U.S. patent application Ser. No. 17/515,751 filed on Nov. 1, 2021, which claims the benefit of priority to U.S. Provisional Patent Application No. 63/108,018, filed Oct. 30, 2020. Each of these applications is incorporated by reference in its entirety herein.

TECHNICAL FIELD

Aspects of the present disclosure relate generally to systems and methods for increasing production in Steam Assisted Gravity Drainage operations and more particularly to an inverted shroud assembly deployed in connection with an electronic submersible pump for Steam Assisted Gravity Drainage production.

BACKGROUND

Crude oil is a commonly used resource comprised of a mixture of naturally occurring hydrocarbons typically found in deep underground natural rock formations or other hydrocarbon reservoirs and is usually found in association with natural gas and water. Crude oil may also be found in semi-solid form mixed with sand and water, such as bitumen found in oil sands formations.

Steam Assisted Gravity Drainage ("SAGD") is an enhanced oil recovery method for production of heavy and extra heavy crude oils, such as bitumen, that do not flow like other types of crude oil. SAGD involves injecting high-temperature steam into a formation through an injection wellbore, to heat the heavy crude oil and bitumen to reduce its viscosity, allowing it to flow to a production wellbore. At the production wellbore, an electric submersible pump ("ESP") pumps the heavy crude oil and bitumen to the surface for further processing.

The flow of well fluids may also cause steam from injection, as well as natural gas, water, and sand found in the formation, to migrate into the ESP. Gas production and sand production may decrease production performance of SAGD operations by eroding components, impeding wellbore access, and interfering with operation of equipment, such as the ESP.

It is with these observations in mind, among others, that various aspects of the present disclosure were conceived and developed.

SUMMARY

Implementations described and claimed herein address the foregoing problems by providing systems and methods for increasing production in Steam Assisted Gravity Drainage operations. In one implementation, an upper mating unit of an inverted shroud assembly is received with a lower mating unit of the inverted should assembly in a slidable relationship. The upper mating unit is coupled to a pump-intake assembly. The lower mating unit is coupled to a motor-seal assembly. The slidable relationship secures the pump-intake assembly to the motor-seal assembly. A motor of the motor-seal assembly is directly cooled by opening the motor to a production well based on an exterior attachment of the motor-seal assembly relative to an inverted shroud. Flow velocity and gas separation are increased inside the inverted shroud based on a mirrored relationship between a first outer diameter of the inverted shroud and a second outer diameter of motor-seal assembly. Other implementations are also described and recited herein. Further, while multiple implementations are disclosed, still other implementations of the presently disclosed technology will become apparent to those skilled in the art from the following detailed description, which shows and describes illustrative implementations of the presently disclosed technology. As will be realized, the presently disclosed technology is capable of modifications in various aspects, all without departing from the spirit and scope of the presently disclosed technology. Accordingly, the drawings and detailed description are to be regarded as illustrative in nature and not limiting.

BRIEF DESCRIPTION OF THE DRAWINGS

The foregoing summary, as well as the following detailed description, will be better understood when read in conjunction with the appended drawings. For the purpose of illustration, there is shown in the drawing certain embodiments of the present inventive concept. It should be understood, however, that the present inventive concept is not limited to the precise embodiments and features shown. The accompanying drawing, which is incorporated in and constitutes a part of this specification, illustrates an implementation of apparatuses consistent with the present inventive concept and, together with the description, serves to explain advantages and principles consistent with the present inventive concept, in which.

DETAILED DESCRIPTION

Aspects of the present disclosure involve systems and methods increasing production in a SAGD system. In one aspect, a SAGD system includes an inverted shroud assembly deployed in connection with an ESP. The inverted shroud assembly includes a motor-seal assembly attached to a lower mating unit at a base of an inverted shroud. An upper mating unit is attached to a pump-intake assembly. The upper mating unit may be easily slid into the lower mating unit inside the inverted shroud without manual manipulation by personnel. The slidable relationship of the upper mating unit and the lower mating unit decreases assembly time and costs by eliminating the need for personnel to manually secure the pump-intake assembly to the motor-seal assembly.

Additionally, the motor-seal assembly is attached exterior to the inverted shroud. The exterior attachment of the motor-seal assembly to the inverted shroud opens the motor to the SAGD wellbore for cooling and decreases resources expending during assembly, for example, by eliminating a recirculation system. ESP reliability risks associated with sand and/or gas production, which may cause recirculation tubes to clog and thus the motor to fail prematurely, are similarly decreased. The exterior attachment also enables a motor cable to be run externally to the inverted shroud, rather than internally, thereby increasing flow velocity and gas separation inside the inverted shroud, which in turn increases production performance of the SAGD system. Based on the exterior attachment, the motor-seal assembly may have an outside diameter mirroring an outside diameter of the inverted shroud, such that the outer diameters are the same or substantially the same. The mirrored relationship of the outside diameters of the inverted shroud and the motor-assembly further increase production performance and reliability of the inverted shroud assembly.

The inverted shroud assembly may include drain ports disposed within the lower mating unit, extending from an interior of the lower mating unit to an underside of the lower mating unit. The underside of the lower mating unit is exterior to the inverted shroud. The upper mating unit may be translated along an axis to expose drain ports in the lower mating unit, which decreases pull risks by facilitating the emptying of shroud fluids and decreasing the risks of sand production or scale buildup that could otherwise break the drain ports.

The presently disclosed technology thus: increases production performance of SAGD operations; decreases assembly length, time, and costs; and decreases risks associated with ESP reliability. Other advantages will be apparent from the present disclosure.

Figure 1:
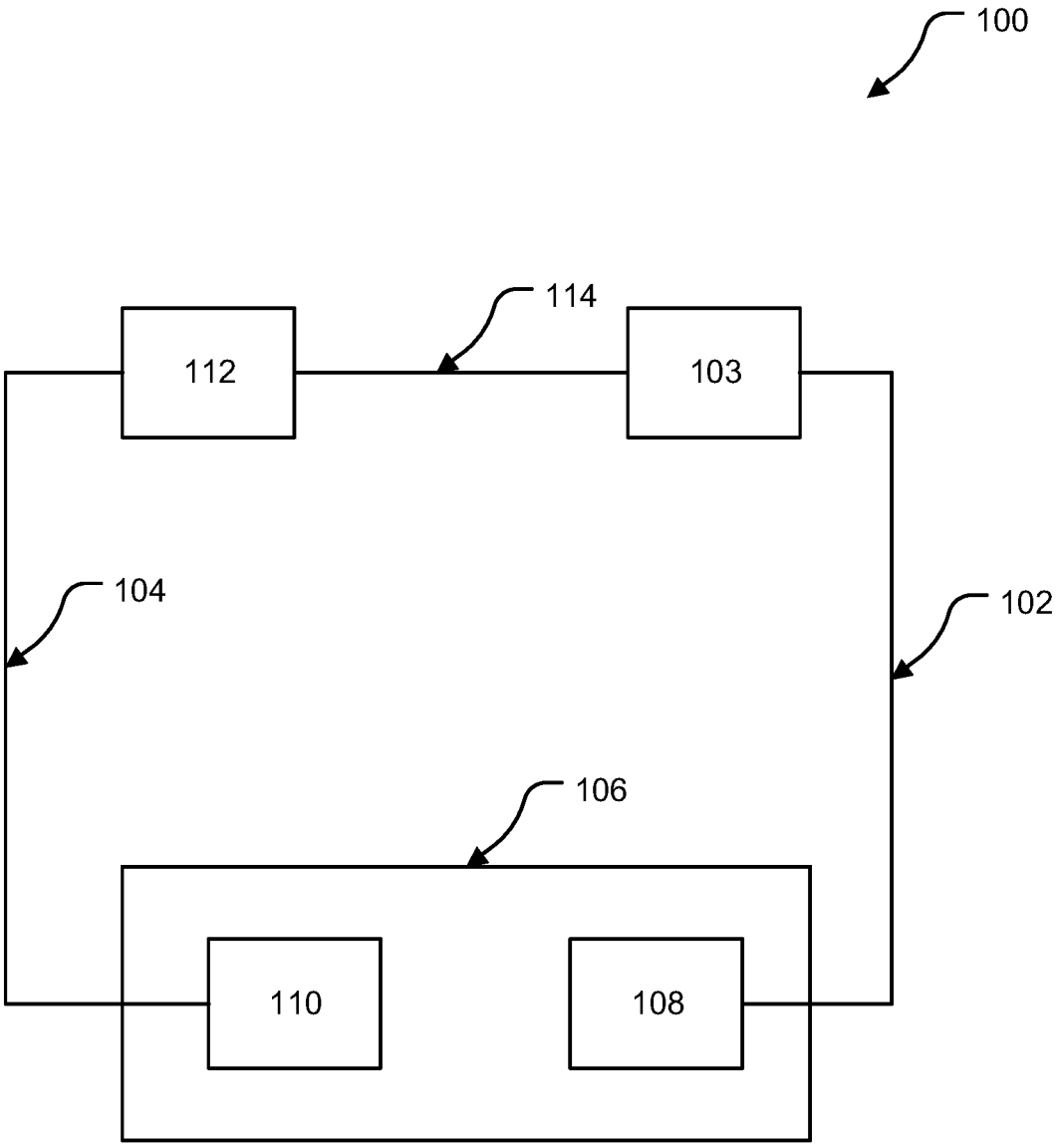
FIG. 1 is a functional block diagram of an example SAGD system with an inverted shroud assembly according to the presently disclosed technology.

To begin a detailed description of systems and methods for increasing production in SAGD operations, reference is made to FIG. 1, which illustrates a SAGD system 100. Those skilled in the art will recognize that FIG. 1 is a schematic only and, therefore, various equipment, apparatuses, or systems for SAGD operations have been omitted for clarity. Such components might include, for example, wellheads, processing and storage facilities, temperature and pressure controls, pumps, motors, filters, heat exchangers, valves, and/or the like. Those skilled in the art will recognize such components and how they are integrated into the systems and methods disclosed herein.

Referring to FIG. 1, in one implementation, the SAGD system 100 involves an injection wellbore 102 and a production wellbore 104 drilled into a reservoir or formation, such as oil sands formation 106 including heavy crude oil and bitumen. A steam generator 103 produces steam to be injected through the injection wellbore 102 to the formation 106 via steam injector 108. The steam injected into the formation 106 heats heavy crude oil and bitumen, allowing it to flow into the production wellbore 104.

At the production wellbore 104, an ESP pumps the well fluids to the surface, where the well fluids can be stored and/or separated at facility 112. Water separated from the crude oil can then transported to the steam generator 103 via water recycling 114. In many instances, the flow of well fluids into the production wellbore 104 may also cause steam from injection, as well as natural gas, water, and sand found in the formation, to migrate into the ESP. Gas production and sand production may decrease production performance of SAGD operations by eroding components, impeding wellbore access, and interfering with operation of equipment, such as the ESP.

In some cases, to mitigate gas production, the ESP may be inserted into an inverted shroud, which directs the flow of production around the outside of the inverted shroud, allowing steam and gas to escape up the production wellbore 104 and well fluids to flow into the inverted shroud to the ESP intake. A recirculation system recirculates the well fluids around the ESP motor, in an effort to keep the motor cool, and the motor cable is run through the inside of the inverted shroud to the motor. However, this arrangement increase risks associated with ESP reliability, thereby limiting production performance. Such risks include sand and/or gas production that may cause: the ESP to get stuck inside the shroud; the recirculation tubes to clog, thereby causing the motor to fail prematurely; and the drain ports being prevented from emptying fluids when pulling the equipment from the production well 104. These risks may become cost prohibitive and decrease production, trying to remove stuck equipment and/or retrieve wet tubing. Further, additional components, such as the inverted shroud and recirculation system, increase assembly length, time, and cost.

To address these concerns, in one implementation, the ESP-inverted shroud assembly 110 includes a motor-seal assembly attached to a lower mating unit at a base of an inverted shroud and an upper mating unit is attached to a pump-intake assembly. As described herein, the upper mating unit has a slidable relationship with the lower mating unit to facilitate securing the pump-intake assembly to the motor-seal assembly. The motor-seal assembly has an exterior attachment with the inverted shroud, which opens the motor to the production wellbore 104 for direct cooling without a recirculation system. With this arrangement of the ESP-inverted shroud assembly 110, the inverted shroud and the motor-seal assembly may have mirrored outside diameters, which in turn increases production performance of the SAGD system 100. Moreover, the arrangement of the ESP-inverted shroud assembly 110 permits one or more drain ports disposed on the lower mating unit to be exposed for emptying shroud fluids by sliding the upper mating unit and decreases pull risks and risks associated with pulling wet tubing.

Referring to FIGS. 2A-2D, in one implementation, the ESP-inverted shroud assembly 110 includes a lower portion 202 and an upper portion 204. In one implementation, the lower portion 202 includes a lower mating unit 206 coupled to an inverted shroud 208 and a motor-seal assembly 210. The inverted shroud 208 is coupled to the lower mating unit 206 opposite the motor-seal assembly 210. The inverted shroud 208 includes an inverted shroud interior surface 212 defining an inverted shroud cavity 214. The motor-seal assembly 210 includes a motor 216 and a seal 218 to protect the motor 216. The motor-seal assembly 210 may have an outside diameter that mirrors an outside diameter of the inverted shroud 208, such that the outside diameters are the same or substantially the same. For example, the motor-seal assembly 210 may have an outside diameter of 5" and the inverted shroud 208 may have an outside diameter of 5". However, other dimensions are contemplated.

The lower portion may include a pothead 220 coupled to the motor 216 and a motor cable 222 coupled to the pothead 220. In one implementation, the motor cable 222 extends from the pothead 220, through the production wellbore 104, and to a power source on the surface. The motor cable 222 may be secured to an exterior of the inverted shroud 208. For example, the motor cable 222 may be banded to the exterior of the inverted shroud 208. The motor cable 222 being secured to the exterior of the inverted shroud 208, rather than internally, increases flow velocity and gas separation inside the ESP-inverted shroud assembly 110.

Figure 2A:
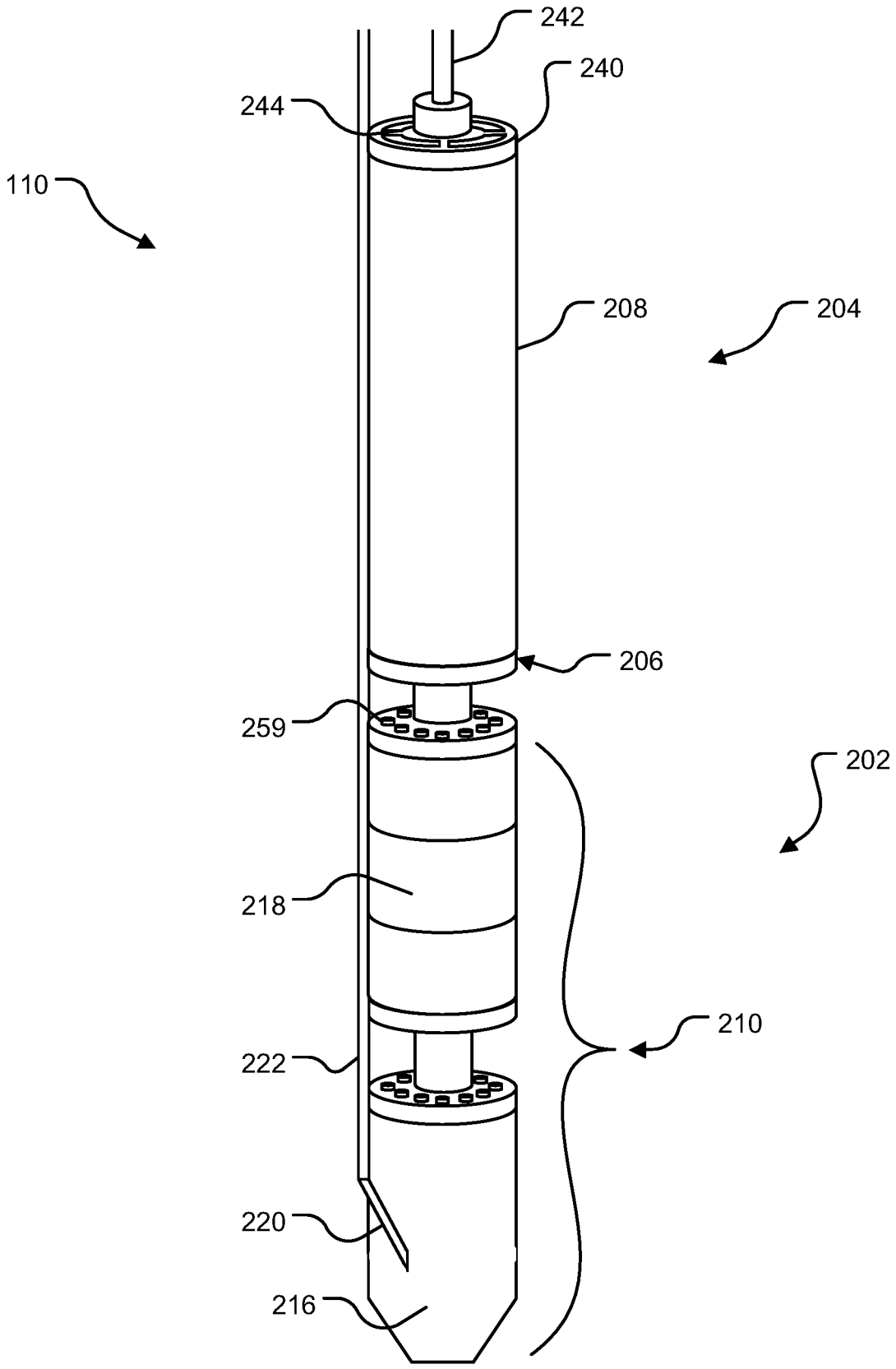
FIG. 2A is a front perspective view of an example inverted shroud assembly for a SAGD application.
Figure 2B:
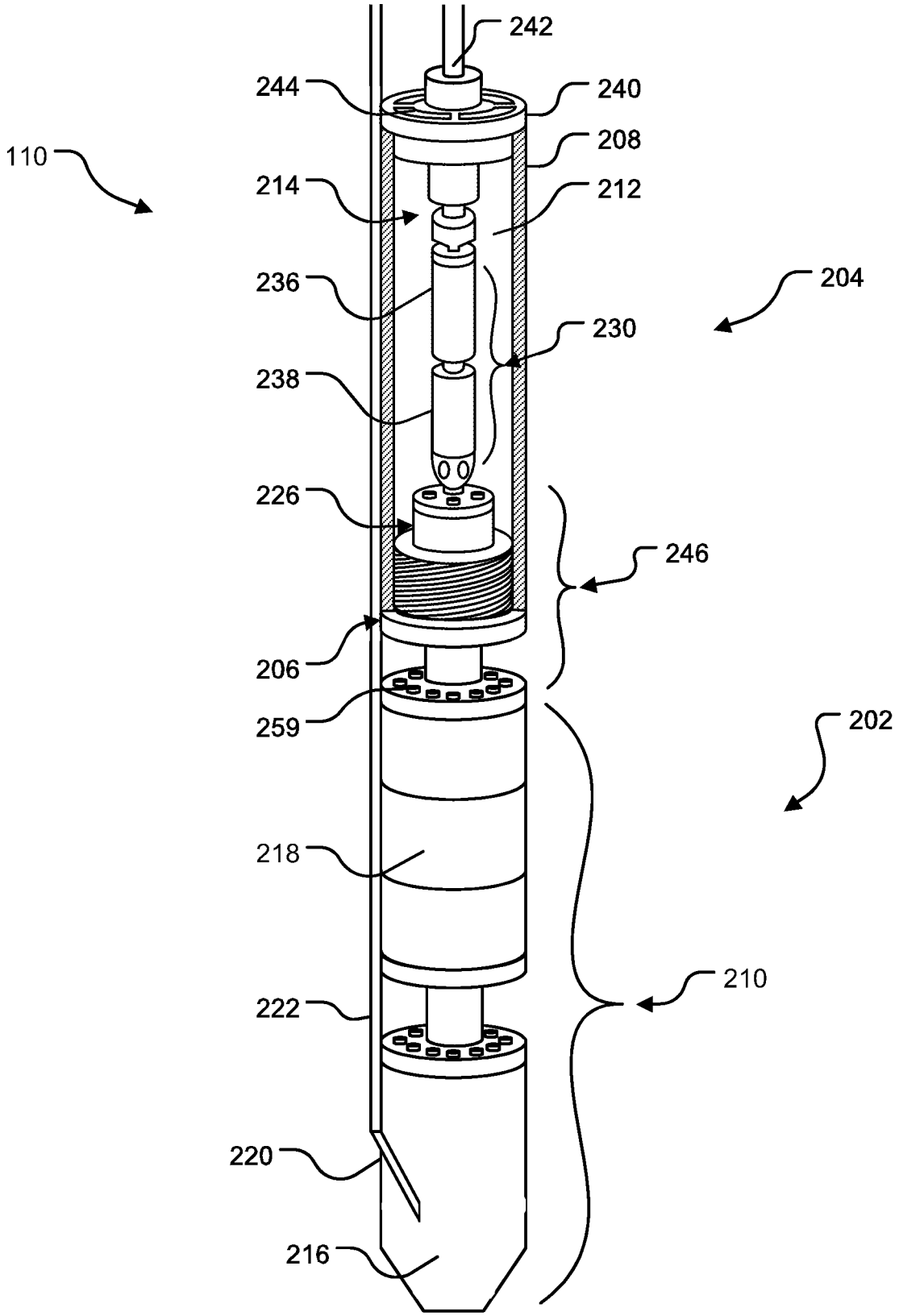
FIG. 2B is a front perspective cut away view of the example inverted shroud assembly of FIG. 2A.
Figure 2C:
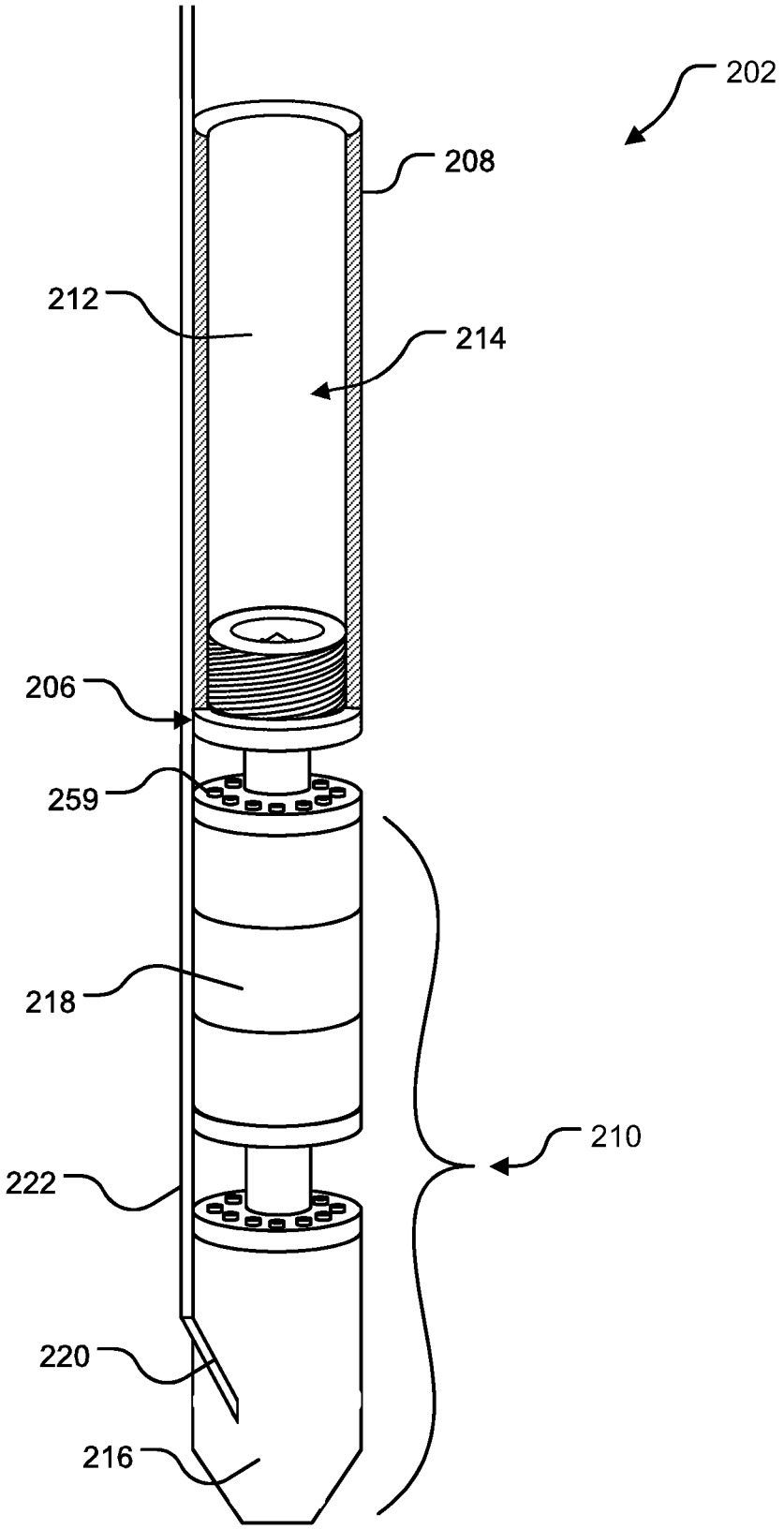
FIG. 2C is a front perspective cut away view of an example lower portion of the inverted shroud assembly of FIG. 2A.

In one implementation, the upper portion 204 includes an upper mating unit 226 coupled to a pump-intake assembly 230. The pump-intake assembly 230 includes a pump 236 and an intake 238 having a pump-intake flange 239. The upper mating unit 226 may be coupled to the pump-intake assembly 230 at the pump-intake flange 239, and the pump-intake assembly 230 may be secured to the pump-intake flange 239 by fasteners, such as bolts 259 and/or the like. In one implementation, the inverted shroud cavity 214 receives the upper portion 204, for example as illustrated in FIGS. 2A and 2B. The upper mating unit 226 slidably couples the lower mating unit 206 within the inverted shroud 208. The upper mating unit 226 and the lower mating unit 206 may define a pump-to-seal mating unit 246, for example as can be understood from FIGS. 9 and 10. The upper portion 204 may include a shroud hanger 240 attached to a production tube 242. The production tube 242 is coupled to the pump-intake assembly 230 for transporting well fluids to the storage, separation facility 112, and/or the like through the production wellbore 104. The inverted shroud 208 may be secured to shroud hanger 240, such that the shroud hanger 240 bears the weight of the pump-intake assembly 230 and the lower portion 202. The shroud hanger 240 includes shroud openings 244 to allow the well fluids to flow into the inverted shroud cavity 214 of the inverted shroud 208.

Figure 3:
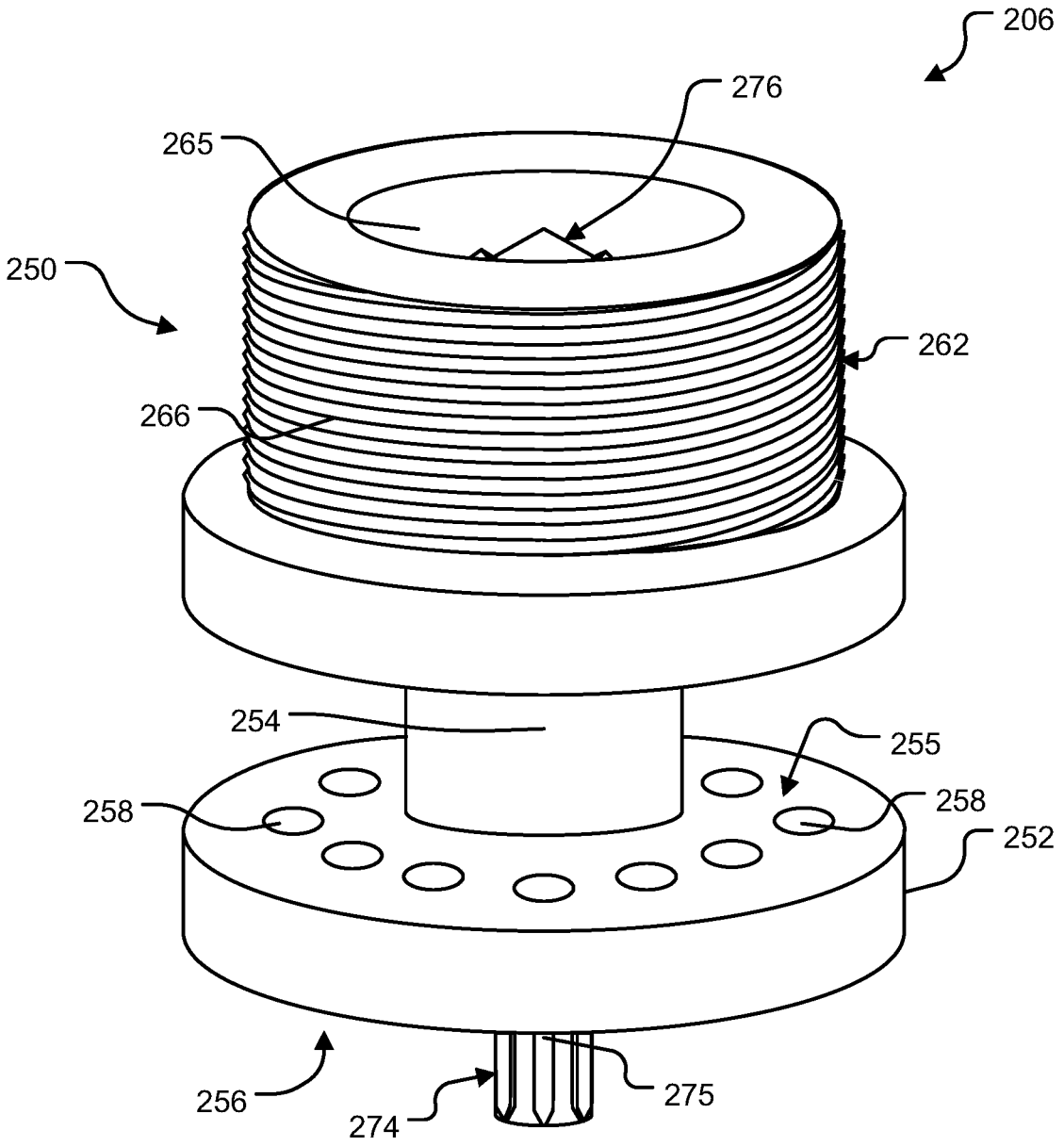
FIG. 3 is a front perspective view of an example lower mating unit of the inverted shroud assembly of FIGS. 2A-2D.

Referring to FIG. 3, in one implementation, the lower mating unit 206 includes a lower top 250, a lower mounting flange 252, and a lower center 254. On the underside of the lower mounting flange 252 is a motor-seal mating surface 256. The lower mating unit 206 is coupled to the motor-seal assembly 210 at the motor-seal mating surface 256. The lower mounting flange 252 may include a plurality of apertures 258 that extend through the mounting flange 252 from a top side 255 of the mounting flange 252 to the motor-seal mating surface 256. A plurality of fasteners, such as a plurality of bolts 259, may be inserted through the plurality of apertures 258 to secure the motor-seal mating surface 256 to the motor-seal assembly 210.

The lower top 250 may include a lower top exterior surface 262 and a lower top interior surface 264. The lower top interior surface defines a lower top interior cavity 265. A fastener is disposed on the lower top exterior surface 262 for coupling the inverted shroud 208 to the lower mating unit 206. For example, the lower top exterior 262 may include threads 266 that connect to corresponding threads 266 disposed on at least a portion of the inverted shroud interior surface 212.

Figure 4:
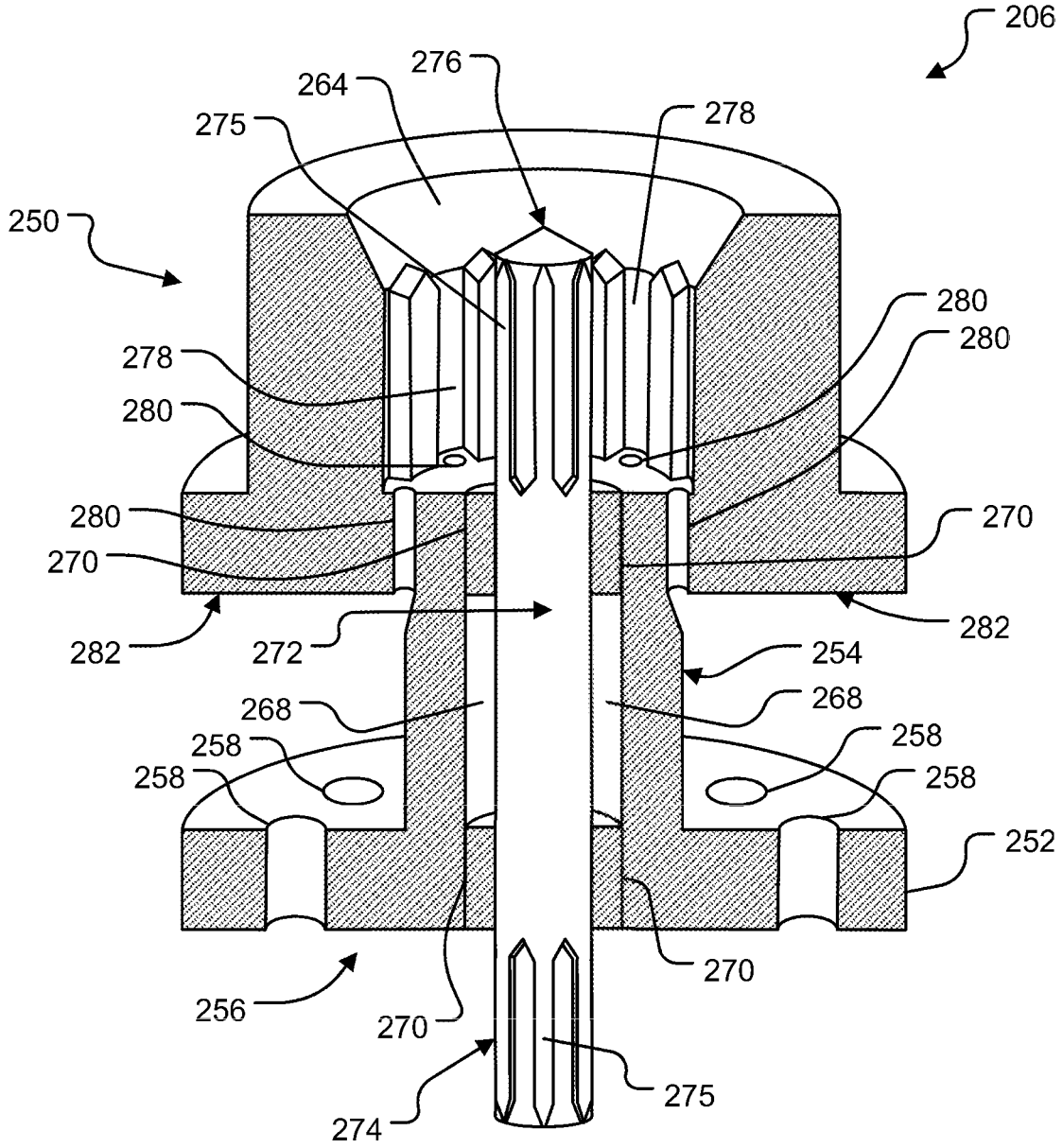
FIG. 4 is a front perspective cut away view of the lower mating unit of FIG. 3.
Figure 5:
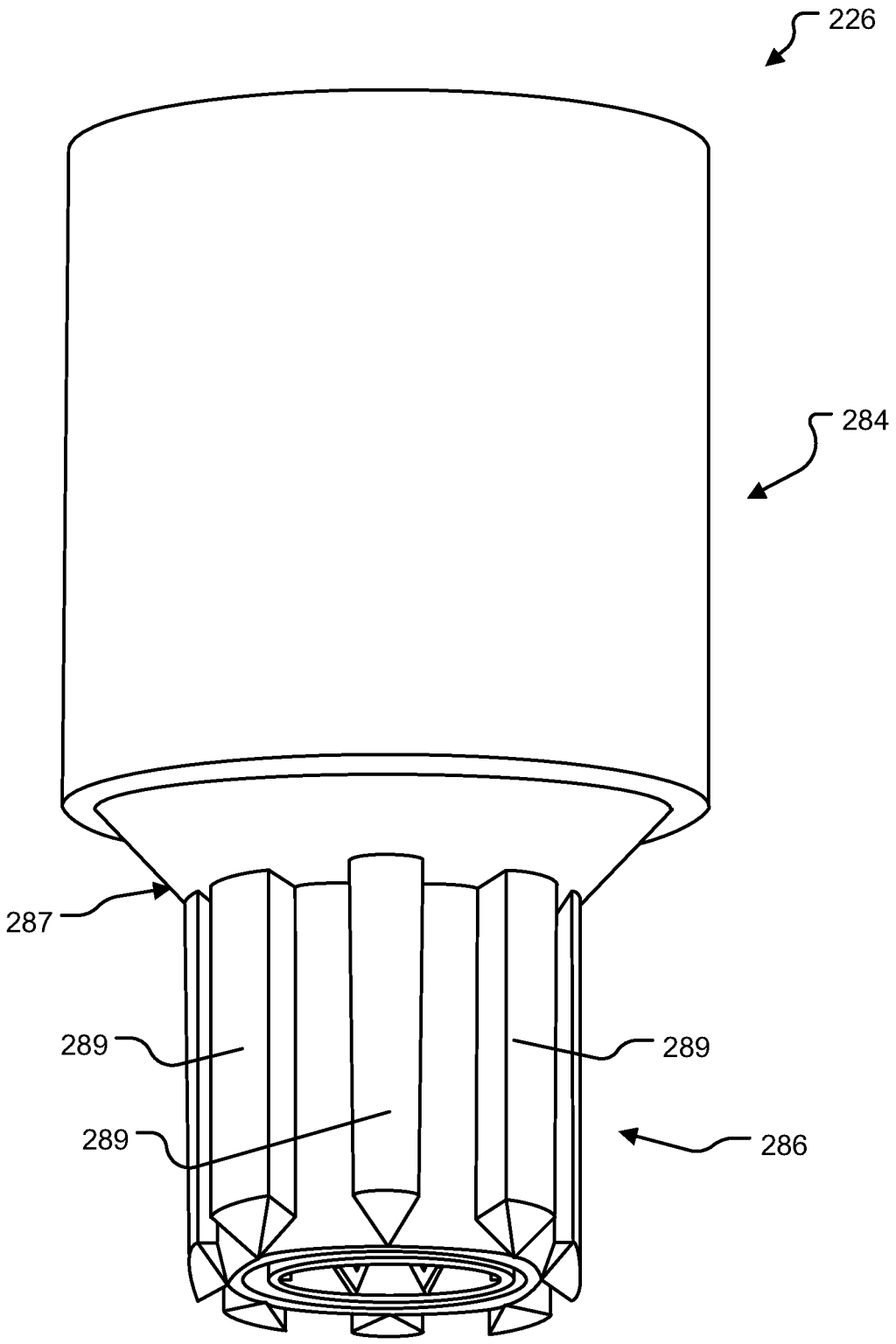
FIG. 5 is a front perspective view of an example upper mating unit of the inverted shroud assembly of FIGS. 2A-2D.
Figure 6:
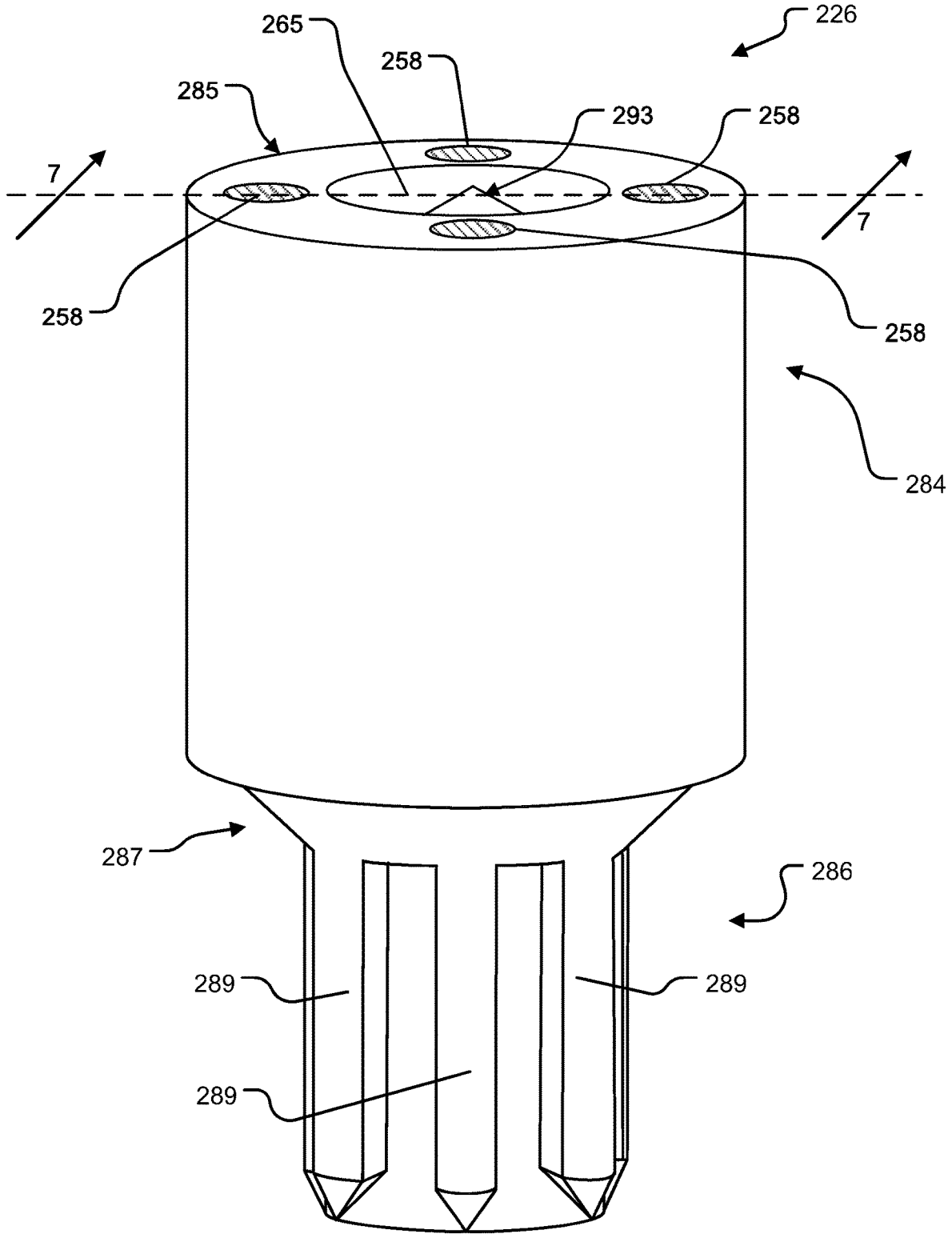
FIG. 6 is a front perspective view of the upper mating unit of FIG. 5.

Turning to FIG. 4, a front perspective cut away view of the lower mating unit 206 of FIG. 3 is shown, with the front portions of the lower top 250, the lower mounting flange 252, and the lower center 254 cut away to expose a lower shaft 272 disposed within a lower channel 268 extending through the lower center 254.

In one implementation, the lower center 254 includes the lower channel 268 extending through the lower center 254 from the motor-seal mounting surface 256 to the lower top interior surface 264. A plurality of lower bushings 270 are disposed in the lower channel 268. The lower shaft 272 is disposed within the lower channel 268 through the plurality of lower bushings 270. The lower shaft 272 includes a lower shaft bottom 274 extending from the lower channel 268 perpendicular to the motor-seal mounting surface 256. The lower shaft bottom 274 includes a plurality of splines 275. The lower shaft includes a lower shaft top 276 extending from the lower channel 268 into the lower top interior cavity 265. The lower shaft top 276 includes a plurality of splines, such as plurality of splines 275.

The lower top interior surface 264 may be shaped to mirror the upper mating unit 226, such that the lower top interior surface 262 and the upper mating unit engage in a slidable relationship. Stated differently, the lower top interior surface 262 may slidably receive the upper mating unit 226 within the lower top interior cavity 265. For example, the lower top interior surface 264 may include a slanted surface and a plurality of grooves 278. However, it is foreseen that the shape of the lower top interior surface 264 may include any shape to engage the upper mating unit 226 within the lower top interior cavity 265.

In one implementation, the lower top 250 includes a plurality of drain ports 280. The plurality of drain ports 280 may extend from the lower top interior surface 264 to a lower top underside 282. The plurality of drain ports 280 direct well fluids to empty from the inverted shroud cavity 214 during a pull in connection with the ESP-inverted shroud assembly 110 being pulled from the production wellbore 104, thereby allowing fluid communication between the plurality of drain ports 280 and the inverted shroud cavity 214.

Referring to FIGS. 5-8, in one implementation, the upper mating unit 226 includes an upper top 284, an upper bottom 286, and an upper center 288 disposed through the upper top 204 and the upper bottom 286.

The upper bottom 286 includes an upper bottom exterior surface 287. The upper bottom exterior surface 287 is such that the upper bottom exterior surface 287 engages the lower top interior surface 262 of the lower mating unit 206 in a slidable relationship. For example, the upper bottom exterior surface 287 may include a slanted surface and a plurality of ridges 289. The plurality ridges 289 are slidably received by the plurality of grooves 278, thereby enabling the upper mating unit 226 to slidably couple the lower mating unit 206 within the inverted shroud 208.

Figure 2D:
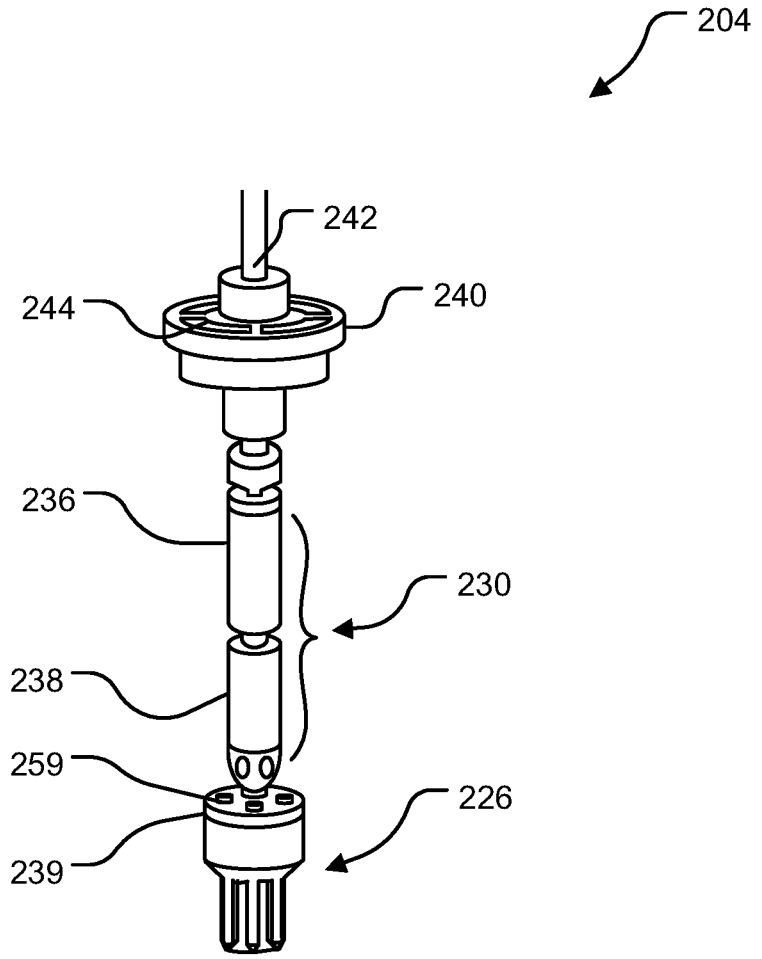
FIG. 2D is a front perspective view of an example upper portion of the inverted shroud assembly of FIG. 2A.

The upper top 284 includes a pump-intake mounting surface 285. The upper mating unit 226 is coupled to the pump-intake assembly 230 at the pump-intake mounting surface 285. The pump-intake mounting surface 285 includes a plurality of apertures 258. Each of the plurality of apertures 258 receives one of a plurality of fasteners, for example, one of the plurality of bolts 259, as illustrated in FIG. 2D. The plurality of fasteners secure the upper mating unit 226 to the pump-intake assembly 230.

Figure 7:
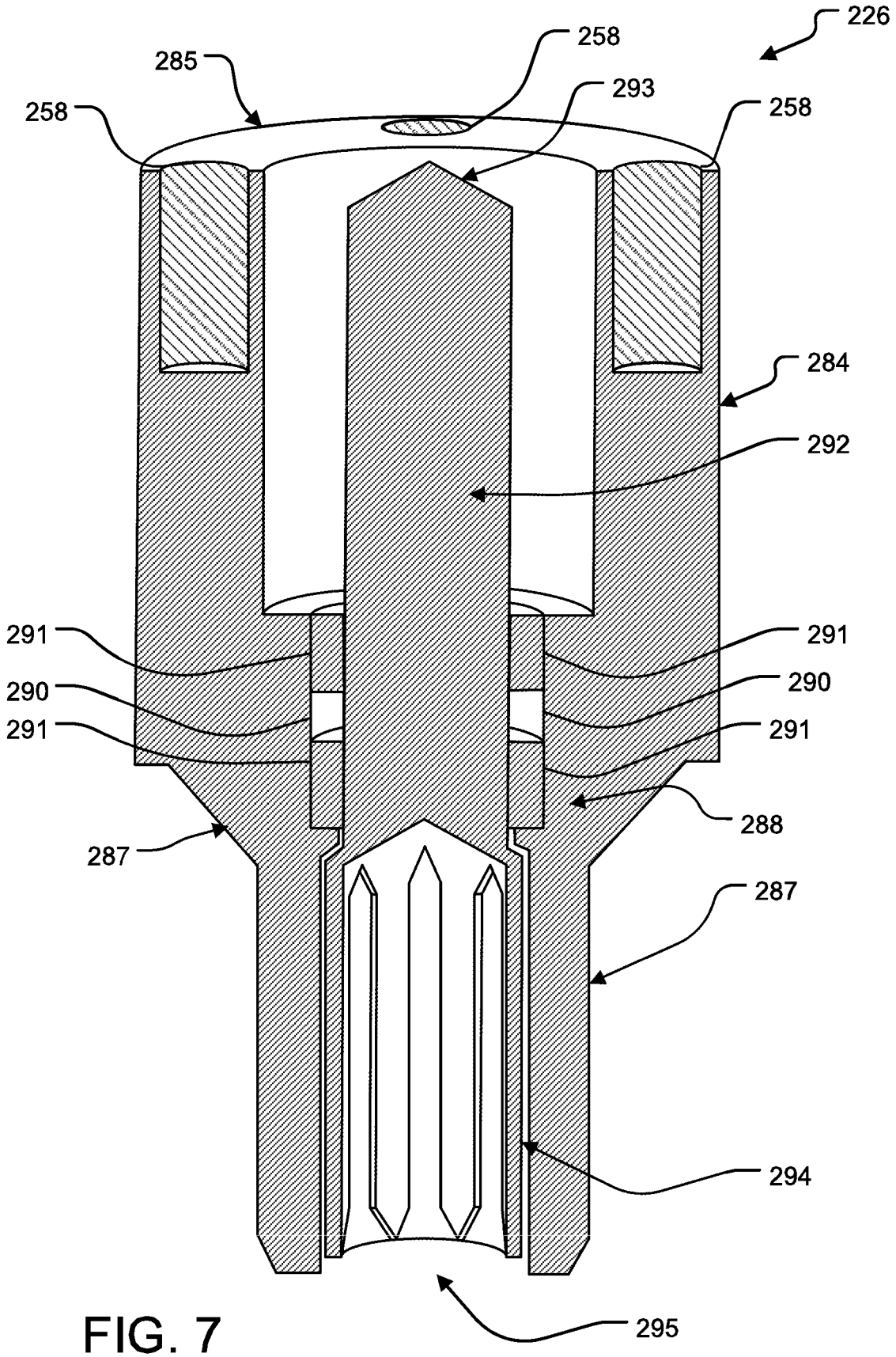
FIG. 7 is a front perspective sectional view of the upper mating unit of FIG. 5.
Figure 8:
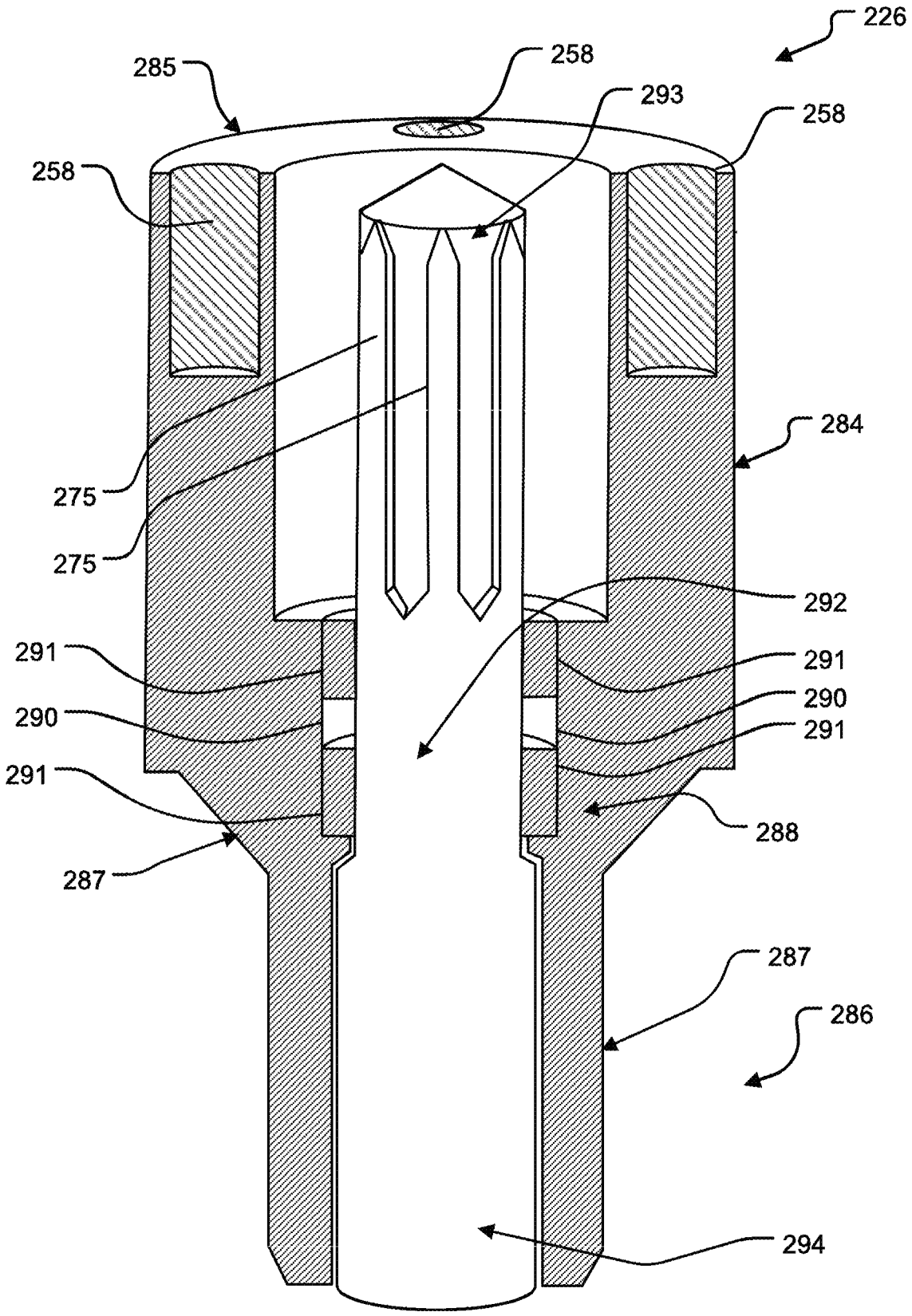
FIG. 8 is a front perspective cut away view of the upper mating unit of FIG. 5.

In one implementation, the upper center 288 is disposed through the center of the upper mating unit 226 and includes an upper channel 290 extending through the upper center 288. The upper channel 290 includes a plurality upper bushings 291. An upper shaft 292 is disposed through the plurality of upper bushings 291 through the upper center 288. The upper shaft 292 includes an upper shaft top 293 extending from the upper channel 290 through at least a portion of the upper top 284. The upper shaft 292 may include a plurality of splines 275, as can be understood in FIG. 8. The upper shaft 292 includes an upper shaft bottom 294 extending from the upper channel 290 through at least a portion of the upper bottom 286. Referring to FIG. 7, the upper shaft bottom 294 includes a female spline shaft 295 that receives and couples the lower shaft top 276 in a rotatable relationship.

Figure 9:
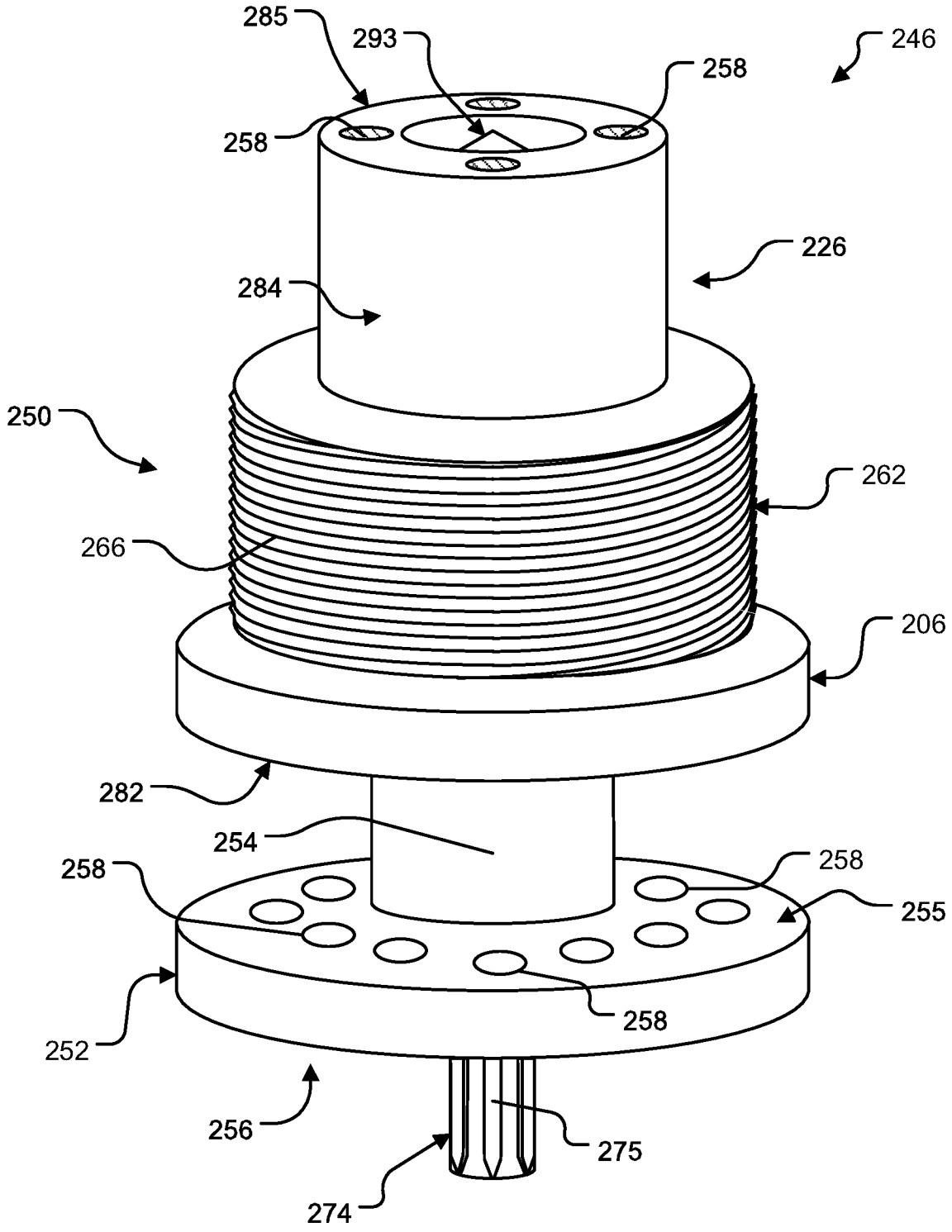
FIG. 9 is a front perspective view of an example pump-to-seal mating unit of the inverted shroud assembly of FIGS. 2A-2D.
Figure 10A:
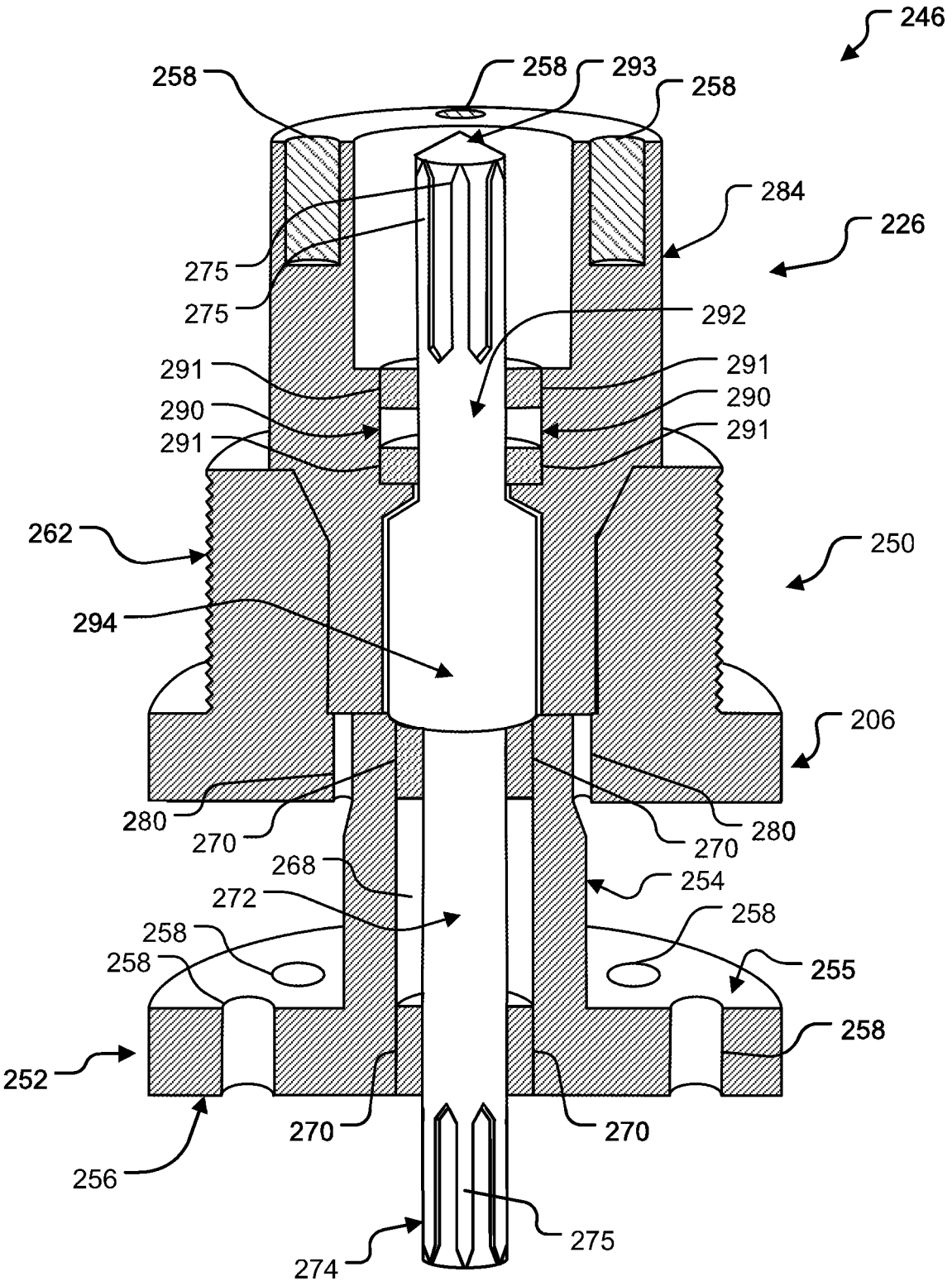
FIG. 10A is a front perspective cut away view of the pump-to-seal mating unit of FIG. 9.

FIGS. 9 and 10A illustrate the lower mating unit 206 slidably and rotatably coupled to the upper mating unit 226. The upper bottom 286 of the upper mating unit 226 is slidably received in the lower top 250 of the lower mating unit 206. The lower shaft top 276 of the lower shaft 272 is received within and rotatably coupled to the female spline shaft 294 of the upper spline shaft 292.

Figure 10B:
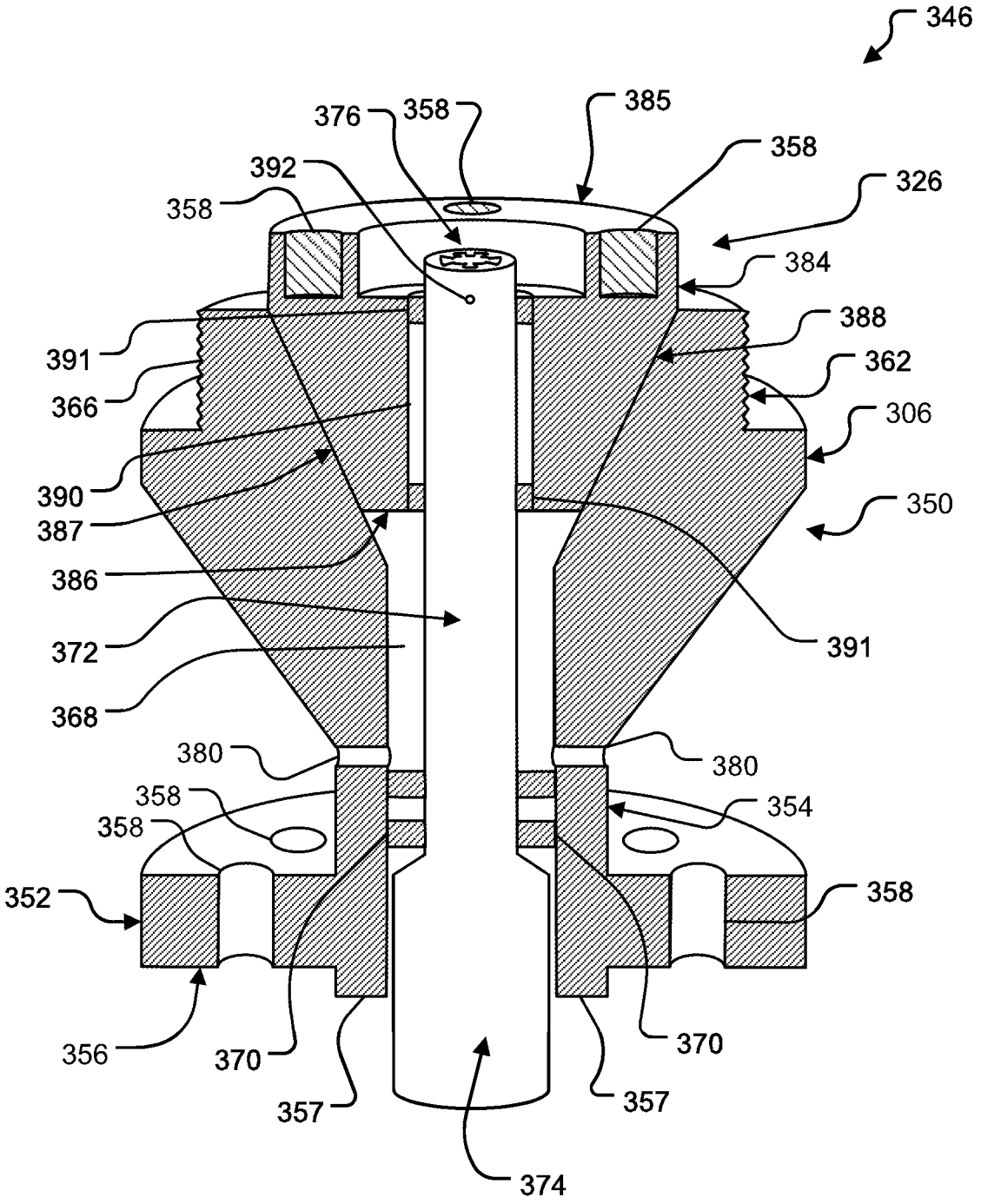
FIG. 10B is a front perspective cut away view of another example a pump-to-seal mating unit.

Referring to FIG. 10B, in one implementation, an upper mating unit 326 and lower mating unit 306 define a pump-to-seal mating unit 346. The upper mating unit 326 includes an upper top 384, an upper bottom 386, and an upper center 388 including an upper channel 390 extending between the upper top 384 to the upper bottom 386. The upper channel 390 includes one or more upper bushings 391.

The upper top 384 includes a pump-intake mounting surface 385 for coupling the pump-intake assembly 230. In one implementation, the pump-intake mounting surface 385 includes a plurality of threaded apertures 385 that receives a fastener to secure the pump-intake assembly 230 to the pump-intake mounting surface 385.

Figure 11A:
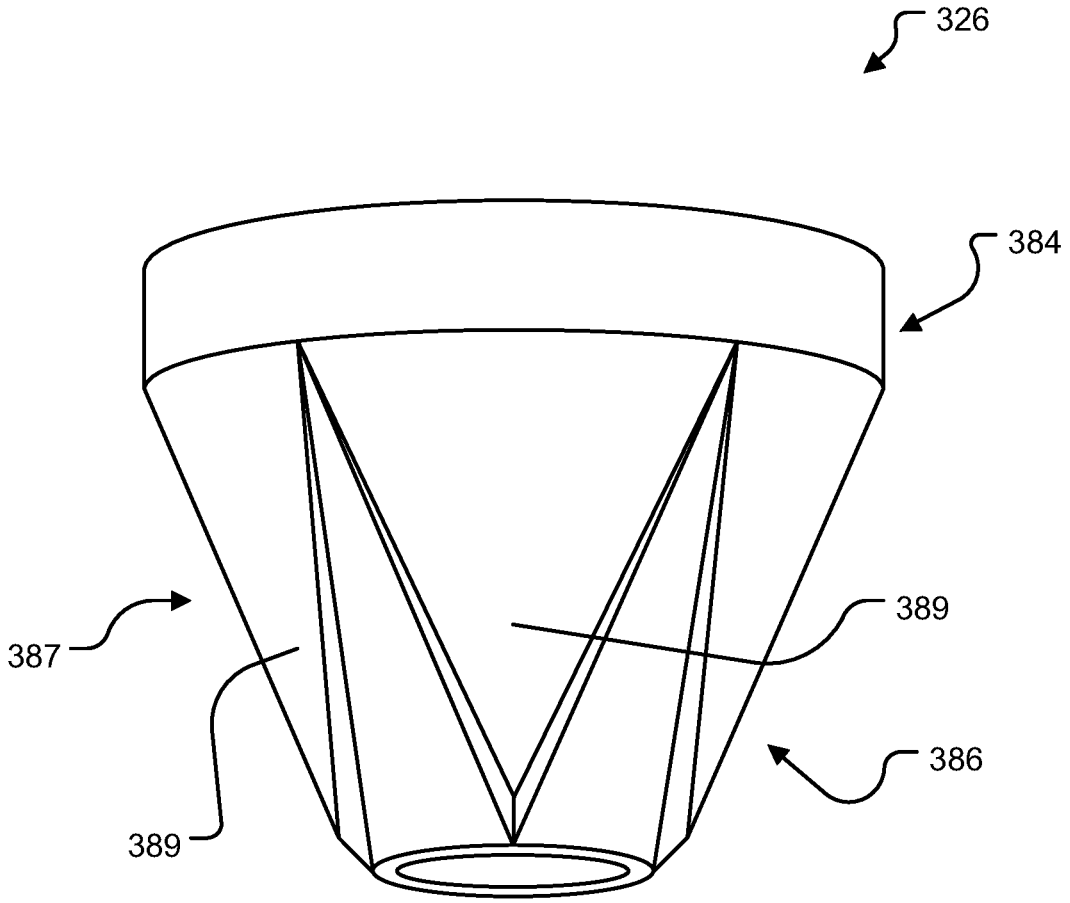
FIG. 11A is a front perspective view of an example upper mating unit of the pump-to-seal mating unit of FIG. 10B.
Figure 11B:
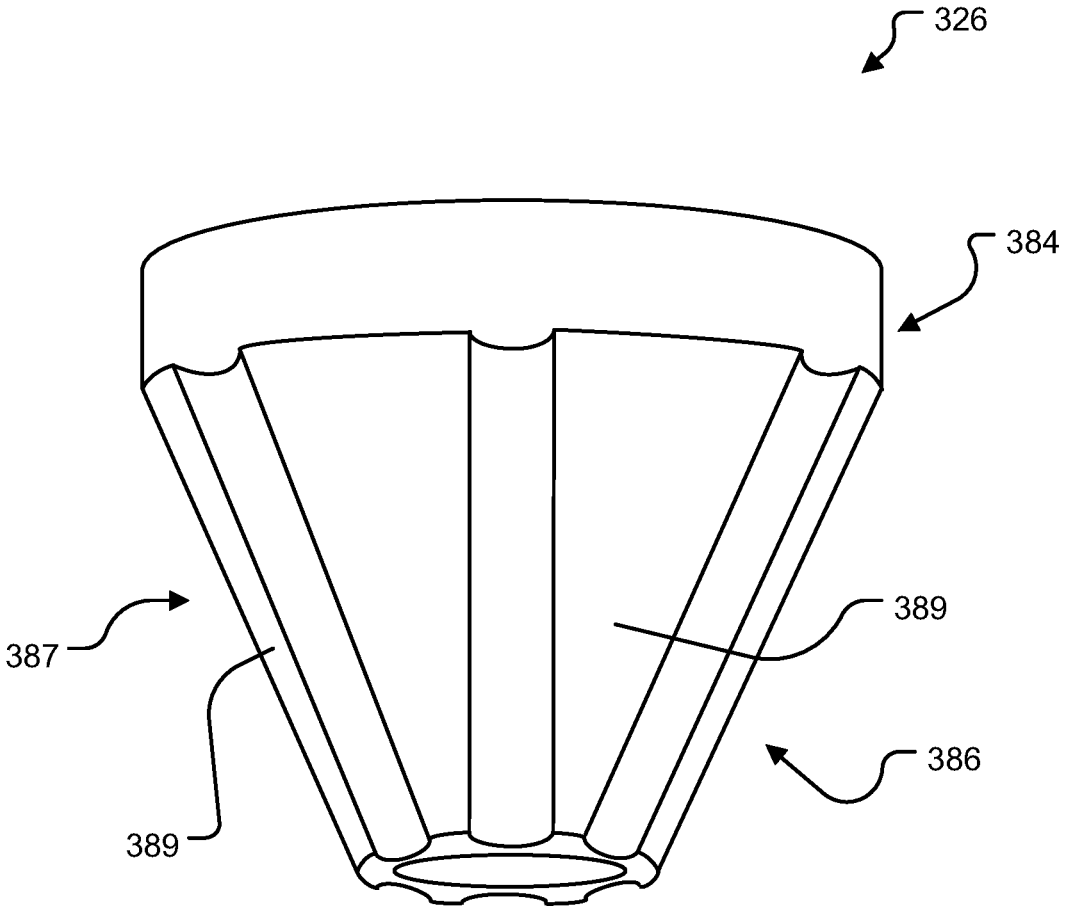
FIG. 11B is a front perspective view of another example upper mating unit of the pump-to-seal mating unit of FIG. 10B.
Figure 11C:
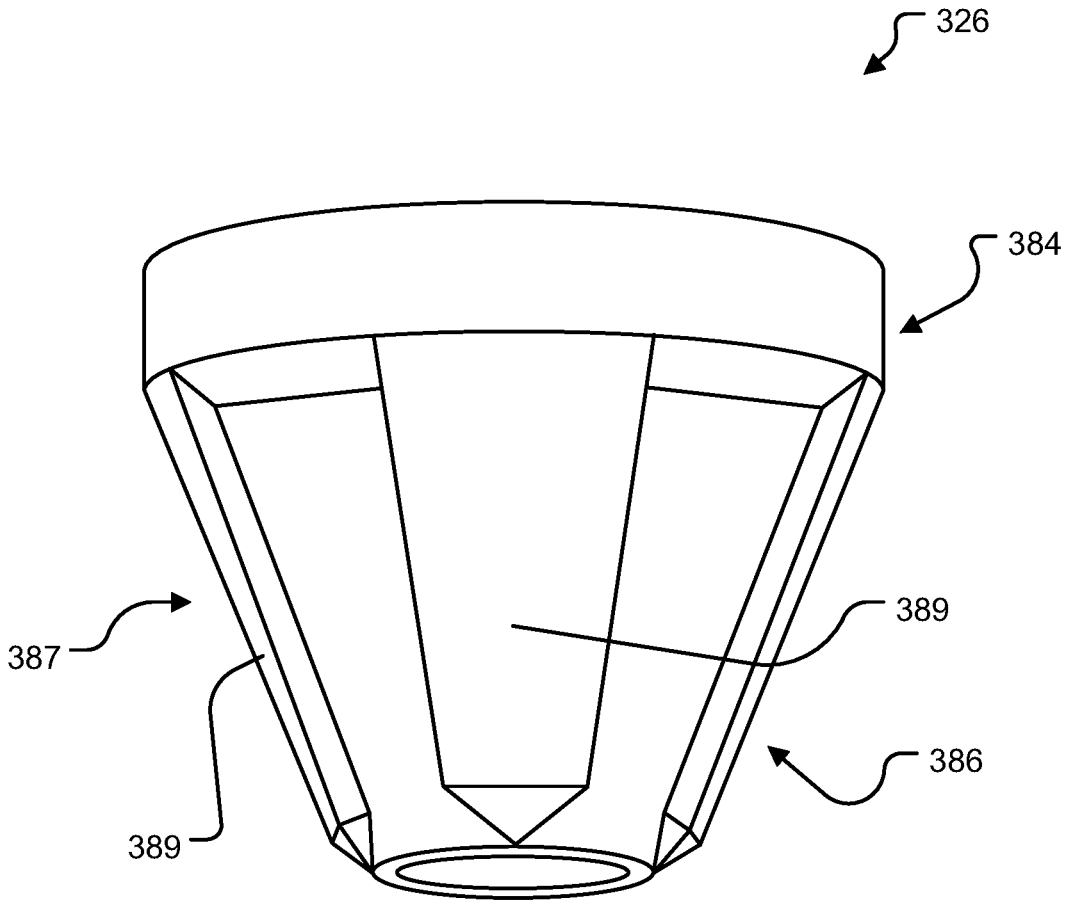
FIG. 11C is a front perspective view of another example upper mating unit of the pump-to-seal mating unit of FIG. 10B.

The upper bottom 386 includes an upper bottom exterior surface 387 for engaging the lower mating unit 306 in a slidable relationship. The upper bottom exterior surface 387 may be tapered and include a plurality of splines 375 for engaging the lower mating unit 306. When torque is applied to the pump-to-seal mating unit 346, the tapered splines 375 lock the upper mating unit 326 and the lower mating unit 306. As such, when the pump 236 is in compression and a housing of the inverted shroud 208 is in tension via the shroud hanger 240, the upper mating unit 326 and the lower mating unit 306 stay seated together. The splines 375 may be triangular to limit binding, as seen in FIG. 11A, rounded, as seen in FIG. 11B, and/or rectangular, as seen in FIG. 11C. However, it is foreseen that other spline shapes may be implemented.

In one implementation, the lower mating unit 306 includes a lower top 350, a lower mounting flange 352, and a lower center 354. The lower top 350 includes a lower top exterior surface 352 and a lower top interior surface 364. The lower top interior surface 364 defines a lower top interior cavity 365. A fastener is disposed on the lower top exterior surface 362 for coupling the inverted shroud 208 to the lower mating unit 306. For example, the lower top exterior 362 may include threads 366 that connect to corresponding threads 366 disposed on at least a portion of the inverted shroud interior surface 212.

The lower center 354 includes a lower shaft 372 disposed within a lower channel 368 extending through the lower center 354. A plurality of bushings may be disposed in the lower channel 368, with the lower shaft 372 disposed through the plurality of bushings 370. The lower shaft 372 includes a lower shaft top 376 extending from the lower center 354 and above the lower top interior cavity 365. When the upper mating unit 326 and the lower mating unit 306 are coupled, the lower shaft top 376 extends through the one or more upper bushings 391 and the upper channel 390 of the upper mating unit 326 to the pump-intake mounting surface 385. The lower shaft top 376 includes a one to three piece shaft coupling to allow the lower shaft 372 to couple a larger or smaller shaft. The lower shaft 372 further includes a lower shaft bottom 374 extending from the lower channel 368 and past the motor-seal mounting surface 356. The lower shaft bottom 374 includes a coupling operable to extend into a top of the motor-seal assembly 210 and mate with a shaft of the motor-seal assembly 210.

The lower center 354 may include a plurality of drain ports 380. The plurality of drain ports 380 may extend from the lower channel 368 to an exterior of the lower mating unit 306. The plurality of drain ports 380 direct well fluids to empty from the inverted shroud cavity 214 during a pull in connection with the ESP-inverted shroud assembly 110 being pulled from the production wellbore 104, thereby allowing fluid communication between the plurality of drain ports 380 and the inverted shroud cavity 214.

On the underside of the lower mounting flange 352 is a motor-seal mating surface 356. The lower mating unit 306 is coupled to the motor-seal assembly 210 at the motor-seal mating surface 356. The motor-seal mating surface includes a raised portion 357 to aid in coupling with the motor-seal assembly 210. The raised portion 357 acts as a guide to assist in centering the coupling of the lower shaft bottom 374 with the shaft of the motor-seal assembly 210.

The lower mounting flange 352 may include a plurality of apertures 358 that extend through the mounting flange 352 from a topside of the mounting flange 352 to the motor-seal mating surface 356. A plurality of fasteners, such as the plurality of bolts 259, may be inserted through the plurality of apertures 358 to secure the motor-seal mating surface 356 to the motor-seal assembly 210.

Figure 12:
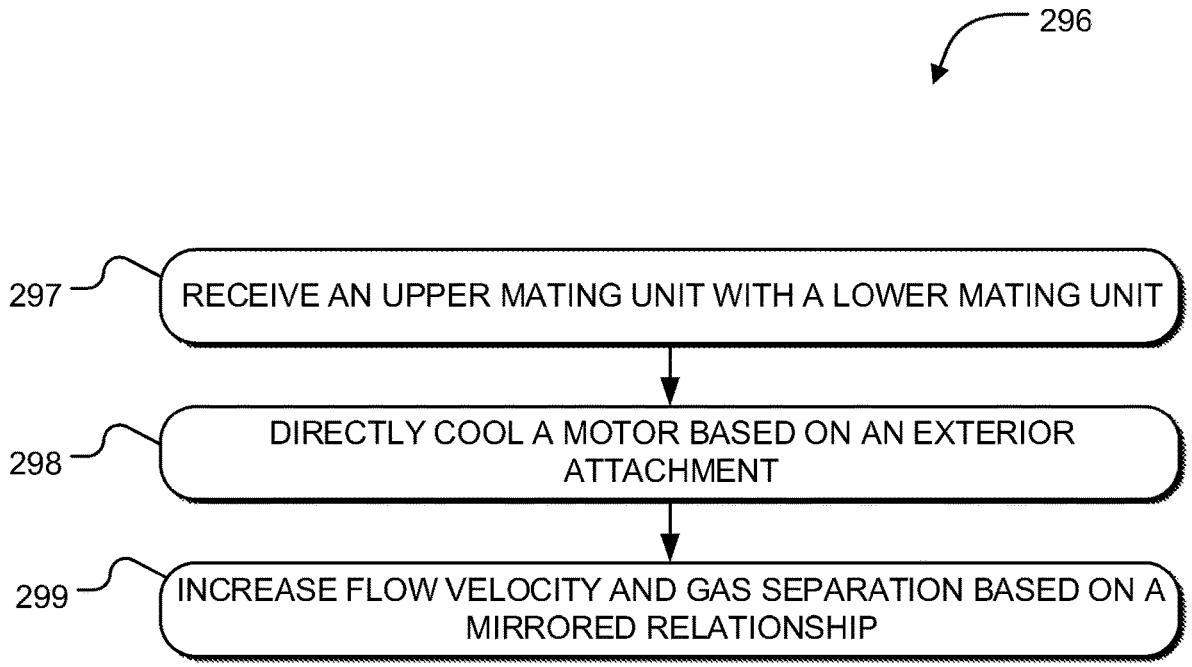
FIG. 12 is a flow chart illustrating example operations for increasing production performance in a SAGD system.

FIG. 12 illustrates an example method 296 for increasing production performance in SAGD operations. In one implementation, an operation 297 receives an upper mating unit of an inverted shroud assembly with a lower mating unit of the inverted should assembly in a slidable relationship. The upper mating unit is coupled to a pump-intake assembly, and the lower mating unit is coupled to a motor-seal assembly. The slidable relationship secures the pump-intake assembly to the motor-seal assembly.

An operation 298 directly cools a motor of the motor-seal assembly by opening the motor to a production well based on an exterior attachment of the motor-seal assembly relative to an inverted shroud. An operation 299 increases flow velocity and gas separation inside the inverted shroud based on a mirrored relationship between a first outer diameter of the inverted shroud and a second outer diameter of motor-seal assembly.

It will be appreciated that the systems and methods described herein are exemplary only and other systems or modifications to these systems may be used to eliminate or otherwise increase production performance in accordance with the presently disclosed technology.

It is understood that the specific order or hierarchy of steps in the methods disclosed are instances of example approaches and can be rearranged while remaining within the disclosed subject matter. The accompanying method claims thus present elements of the various steps in a sample order, and are not necessarily meant to be limited to the specific order or hierarchy presented.

While the present disclosure has been described with reference to various implementations, it will be understood that these implementations are illustrative and that the scope of the present disclosure is not limited to them. Many variations, modifications, additions, and improvements are possible. More generally, implementations in accordance with the present disclosure have been described in the context of particular implementations. Functionality may be separated or combined in blocks differently in various implementations of the disclosure or described with different terminology. These and other variations, modifications, additions, and improvements may fall within the scope of the disclosure as defined in the claims that follow.

What is claimed is:

1. A system for increasing production in Steam Assisted Gravity Drainage operations, the system comprising:

an inverted shroud configured to contain a pump-intake assembly of an Electric Submersible Pump;

a lower mating unit coupled to the inverted shroud and configured to couple to a motor-seal assembly of the Electric Submersible Pump opposite the inverted shroud, the motor-seal assembly having an exterior attachment relative to the inverted shroud, the exterior attachment opening a motor of the motor-seal assembly to a production well for direct cooling; and an upper mating unit disposed within the inverted shroud and configured to couple with the lower mating unit and the pump-intake assembly.

2. The system of claim 1, wherein the inverted shroud has a first outer diameter, and the motor-seal assembly has a second outer diameter, the first outer diameter equal to the second outer diameter.

3. The system of claim 2, wherein the first and second outer diameters are 5 inches.

4. The system of claim 1 further comprising a shroud hanger configured to couple to the inverted shroud at end opposite the lower mating unit.

5. The system of claim 4, wherein the shroud hanger includes one or more shroud openings configured to allow well fluids to flow into an interior of the inverted shroud.

6. The system of claim 1, wherein the lower mating unit includes threads that are configured to couple to corresponding treads disposed on at least a portion of the inverted shroud.

7. The system of claim 1, wherein the production of the Steam Assisted Gravity Drainage operations is increased based on a relationship between a first outer diameter of the inverted shroud and a second outer diameter of the motor-seal assembly.

8. A method comprising:

coupling an upper mating unit to a lower mating unit, the upper mating unit configured to couple to a pump-intake assembly;

coupling the lower mating unit to an inverted shroud, the lower mating unit configured to couple to a motor-seal assembly;

securing the upper mating unit within the inverted shroud;

directly cooling a motor of the motor-seal assembly by opening the motor to a production well based on an exterior attachment of the motor-seal assembly relative to the inverted shroud; and increasing production in a Steam Assisted Gravity Drainage operation based on a relationship between a first outer diameter of the inverted shroud and a second outer diameter of the motor-seal assembly.

9. The method of claim 8, wherein the exterior attachment includes the motor-seal assembly coupled to the lower mating unit opposite the inverted shroud.

10. The method of claim 8, wherein the relationship includes the first outer diameter being equal to the second outer diameter.

11. The method of claim 8, further comprising:

pumping well fluids to a surface using the pump-intake assembly in connection with an Electric Submersible Pump.

12. The method of claim 8, further comprising:

emptying shroud fluids using one or more drain ports.

13. A system for increasing production in Steam Assisted Gravity Drainage operations, the system comprising:

an inverted shroud configured to house a pump-intake assembly;

a lower mating unit coupled to the inverted shroud and configured to be secured to a motor-seal assembly via an exterior attachment relative to the inverted shroud, the exterior attachment opening a motor of the motor-seal assembly to a production well for direct cooling; and an upper mating unit disposed within the inverted shroud and configured to couple to the pump-intake assembly.

14. The system of claim 13, wherein inverted shroud has a first outer diameter, and the motor-seal assembly has a second outer diameter, the first outer diameter equal to the second outer diameter.

15. The system of claim 14, wherein the first and second outer diameters are 5 inches.

16. The system of claim 13 further comprising a shroud hanger configured to couple to the inverted shroud at end opposite the lower mating unit.

17. The system of claim 16, wherein the shroud hanger includes one or more shroud openings configured to allow well fluids to flow into an interior of the inverted shroud.

18. The system of claim 13, wherein the lower mating unit includes threads that are configured to couple to corresponding treads disposed on at least a portion of the inverted shroud.

19. The system of claim 13, wherein the production of the Steam Assisted Gravity Drainage operations is increased based on a relationship between a first outer diameter of the inverted shroud and a second outer diameter of the motor-seal assembly.

* * * * *